United States Patent [19]

Yamamura et al.

[11] 4,302,212

[45] Nov. 24, 1981

[54] DISPERSING AGENTS FOR AN AQUEOUS SLURRY OF COAL POWDER

[75] Inventors: Masaaki Yamamura; Noboru Moriyama; Shinichi Watanabe, all of Wakayama, Japan

[73] Assignee: Kao Soap Company, Limited, Tokyo, Japan

[21] Appl. No.: 165,063

[22] Filed: Jul. 1, 1980

[30] Foreign Application Priority Data

Jul. 26, 1979 [JP] Japan ..... 54-95174

[51] Int. Cl.[3] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 2,550,982 | 5/1951 | Eberz | 44/51 |
| 4,088,453 | 5/1978 | Wiese et al. | 44/51 |
| 4,094,810 | 6/1978 | Thomas | 252/313 R |
| 4,104,035 | 8/1978 | Cole et al. | 44/51 |

*Primary Examiner*—Patrick Garvin
*Assistant Examiner*—Y. Harris-Smith
*Attorney, Agent, or Firm*—Birch, Stewart, Kolasch and Birch

[57] ABSTRACT

Aqueous dispersions of coal powder having good flowability properties are provided by employing, as the dispersing agent, an anionic surface active agent having the formula:

$$[R-O\text{-}(CH_2CH_2O)_m SO_3]_n M$$

wherein R is an alkyl or alkenyl group having 6 to 22 carbon atoms or an alkyl- or alkenyl-substituted aryl group having 4 to 22 carbon atoms in the substituent thereof, m is an integer of from 2 to 50, n is a number of from 1 to 3 and is the same as the valence of the counter ion M, and M is a cation having a valence of from 1 to 3.

18 Claims, No Drawings

DISPERSING AGENTS FOR AN AQUEOUS SLURRY OF COAL POWDER

The present invention relates to a dispersing agent for an aqueous slurry of coal powder. More particularly, the invention relates to a dispersing agent for dispersing coal powder into water to form an aqueous dispersion which can be transported by a pipeline transportation system.

The use of petroleum as an energy source involves ever-increasing problems, such as limited deposits and increasing prices. Accordingly, it is increasingly desirable to develop new energy sources and to maintain a stable supply thereof. Under these circumstances, the effective utilization of coal which is buried in large deposits throughout the world on a reasonably uniform basis is now being reconsidered. However, coal is solid and, accordingly, involves disadvantages as compared to petroleum with respect to transportation and handling, because the pipeline transportation of coal is impossible. Furthermore, the ash content of coal is ordinarily much higher than that of petroleum, and coal involves problems of reduction of the calorific value and disposal of the fly ash.

Methods of pulverizing coal and dispersing the powdered coal into water have been studied as a means for improving the handling characteristics of coal. However, in the case of such aqueous slurries, the viscosity is remarkably increased with a loss in flowability if the coal concentration is increased beyond a certain point. On the other hand, if the concentration of the coal therein is reduced, the transportation efficiency is lowered and an expensive dehydration step is required.

Therefore, such aqueous slurries are not applicable for practical use. Increase of the viscosity and reduction of the flowability in an aqueous slurry of coal are due to agglomeration of the coal particles in the aqueous slurry. The finer the particle size of dispersed coal powder, the better is the dispersion stability thereof. However, the cost of pulverization is increased if the degree of pulverization is enhanced. Finely divided coal now used in thermoelectric power plants has such a size that 80% of the particles will pass through a 200-mesh sieve. That is, this finely divided coal has a particle size of about 74 microns. Accordingly, it is expected that this size may be used as a standard value for finely divided coal.

It may be considered that if a surface active agent acting as a dispersant is added to an aqueous slurry of coal powder, the surface active agent will absorb the coal particles and will exert the desirable functions of crumbling agglomerated particles and also preventing agglomeration of coal particles, with the result that a good dispersion state will be attained. However, when ordinary surface active agents such as salts of alkylbenzene-sulfonates are used, the flowability is not sufficiently improved and an aqueous coal dispersion having a practical utility cannot be obtained.

Accordingly, one of the objects of the present invention is to eliminate the defects encountered in the conventional aqueous slurries of coal powder.

Another object of the invention is to provide an aqueous coal dispersion which may be used and transported in a practical way.

These and other objects and advantages of the invention will become apparent to those skilled in the art from a consideration of the following specification and claims.

It has been found, in accordance with the present invention, that an aqueous slurry of coal powder having a good flowability can be obtained by employing as a dispersing agent an anionic surface active agent having the following formula:

$$[R-O(CH_2CH_2O)_m SO_3]_n M$$

wherein R is an alkyl or alkenyl group having 6 to 22 carbon atoms or an alkyl- or alkenyl-substituted aryl group having 4 to 22 carbon atoms in the substituent thereof, m is an integer of from 2 to 50, n is a number of from 1 to 3 which is the same as the valence of the counter ion M, and M is a cation having a valence of from 1 to 3.

The anionic surface active agent used in the present invention is prepared by adding ethylene oxide to an aliphatic alcohol or alkyl-substituted phenol, sulfating the addition product and then neutralizing the sulfated material.

As the aliphatic alcohol, there can be exemplified alcohols having from 6 to 22 carbon atoms, especially 8 to 18 carbon atoms, such as hexyl alcohol, octyl alcohol, 2-ethylhexyl alcohol, lauryl alcohol, coconut alcohol and oleyl alcohol, and as the alkyl-substituted phenol, there can be mentioned alkyl-substituted phenols having 4 to 22 carbon atoms, preferably 6 to 18 carbon atoms, and particularly preferably from 6 to 12 carbon atoms, in the alkyl substituent thereof, such as hexyl phenol, nonyl phenol and dibutyl phenol. The mole number of added ethylene oxide is preferably 2 to 50, especially 4 to 20.

As the cation M, there can be used, for example, monovalent cations such as hydrogen, sodium, potassium, lithium, ammonia and amines, divalent cations such as calcium, magnesium and diamines, and trivalent cations such as aluminum and triamines.

A non-ionic surface active agent may be used in combination with the anionic surface active agent employed in the present invention. Up to 50 mole % of non-ionic surface active agent, based on the amount of anionic surface active agent, may be used.

The dispersing agent of the present invention is added to an aqueous slurry of coal in an amount of 0.01 to 5.0% by weight, preferably 0.05 to 2.0% by weight, based on the total amount of the aqueous slurry. Ordinarily, when a dispersing agent is not added to an aqueous slurry of coal powder, the viscosity abruptly increases if the concentration of coal exceeds 30% by weight based on the total amount of the slurry, although this critical value differs to some extent depending on the kind and particle size of coal powder. However, even in such a case, if the dispersing agent is added in a predetermined amount, the dispersion state of the coal and the flowability of the dispersion can be improved. If the coal concentration is too low in the aqueous coal slurry, the transportation efficiency is lowered and the necessary dehydration step is expensive, with the result that the significance of the formation of an aqueous coal slurry is lost. If the coal concentration is too high, the viscosity correspondingly becomes too high. Accordingly, the coal concentration is adjusted to 30 to 85% by weight, preferably 50 to 75% by weight, although the coal concentration may be changed to some extent depending on the type of coal and the desired viscosity.

The dispersing agents of the present invention are anionic surface active agents, and they adsorb the organic part of coal particles in the aqueous coal slurry and thereby impart charges thereto, whereby the coal particles are stably dispersed in the slurry. On the other hand, the ash part of coal particles agglomerates, resulting in precipitation to the bottom or flotation on the surface of the slurry. Accordingly, the ash can be separated from the coal in the aqueous coal slurry.

It is known that when fine solid particles are dispersed in a dispersing medium by using a dispersing agent, the dispersability becomes better, the smaller the amount of deposited precipitate. By employing the dispersing agent of the present invention, since the amount of deposited precipitates is small, there can be attained the effect of improving the dehydration characteristic, as well as the above-mentioned effects of improving the transportation characteristic by reduction of the viscosity and facilitation of the separation of the ash.

The order of mixing of the coal, the dispersing agent and water is not critical. However, the preferred mode of the invention comprises dissolving or dispersing the dispersing agent in water and adding the coal thereto. The mixture is then treated by an appropriate mixing apparatus or pulverizing apparatus.

The coal to be employed in the aqueous slurries of the invention includes anthracite coal, bituminous coal, subbituminous coal, brown coal, and the like.

Recently, a method in which an aqueous coal slurry, which has been transported is mixed with a liquid that is immiscible with the dispersing medium water, such as a liquid hydrocarbon, to granulate the coal powder, the granulated coal being separated from the water and recovered, has attracted attention in the art (see, for example, Japanese patent application Laid-Open Specification No. 37901/77). In order to utilize this technique, a liquid hydrocarbon may be added in advance when an aqueous coal slurry is prepared. Also in this case, the dispersing agent of the present invention retains a high dispersing effect even if such a liquid hydrocarbon is present in the slurry, and good results can be obtained.

The following examples are given merely as illustrative of the present invention and are not to be considered as limiting. Unless otherwise noted, the percentages therein and throughout the application are by weight.

EXAMPLE 1

(1) Preparation of Aqueous Slurry and Flowability:

In 195 g of water there was dispersed 5 g of sodium polyoxyethylene (POE) (5 moles) nonylphenyl ether sulfate, and 300 g of Vermont coal (described hereinafter) which had been pulverized so that 80% of the particles could pass through a 200-mesh sieve was added to the mixture little by little at room temperature. Then, the mixture was agitated at 5000 rpm for 5 minutes with a homogenizing mixer (manufactured by Tokushu Kikako) to form an aqueous slurry having a viscosity of 1400 cp as measured at 25° C. The flowability of the slurry was good.

The results of other Examples conducted under similar conditions are shown in Table 1. In Table 1, a lower viscosity indicates a better flowability.

(2) Evaluation of Ease in Removal of Ash:

A stainless steel cylinder having an inner diameter of 5.5 cm and a height of 24 cm and comprising plugged attachment holes at positions 6 cm, 12 cm and 18 cm from the bottom, respectively, was used as a test device. A predetermined amount of the aqueous coal slurry as prepared above was charged in the cylinder so that the slurry was filled to a point 18 cm from the bottom, and the slurry was allowed to stand still for 3 days. After the passage of 3 days, the plug at the position 12 cm from the bottom was taken out, and the aqueous coal slurry located above this plug (the slurry locate along 12 to 18 cm in the cylinder) was withdrawn as an upper layer sample. The ash content in the coal was measured. Then, the plug at the position 6 cm from the bottom was taken out, and the slurry above this plug was withdrawn as an intermediate layer sample and the ash content in the coal was measured. Finally, the remaining aqueous coal slurry was taken out as a lower layer sample and the ash content in the coal was measured. It was found that the ash content was 5.3% by weight in the upper layer, 8.4% by weight in the intermediate layer and 20.7% by weight in the lower layer. The results of other Examples conducted under similar conditions are shown in Table 1.

A larger difference of the ash content among the respective layers indicates a better ash-removing property.

VERMONT COAL (MINED IN AUSTRALIA)

High grade calorific value: 6550 Kcal/Kg (JIS M 8814)
Ash content: 15.95% (JIS M 8812)
Water content: 3.25% (JIS M 8812)
Fixed carbon content: 49.35% (JIS M 8812)
Elementary analysis values (JIS M 8813):
C=69.20%, H=4.71%, N=1.23%, O=8.44%, S=0.50%, Cl=0.03%, Na=0.04%.

TABLE 1

| | Results of Examples | | | | | | | |
|---|---|---|---|---|---|---|---|---|
| | | | Flowability | | Ash Removing Property[5] (ash content) | | | |
| Dispersing Agent | Amount[1] | Coal Concentration (%) | Viscosity[2] (cp) | Evaluation[3] | upper layer | intermediate layer | lower layer | Evaluation[3] |
| Comparative Samples | | | | | | | | |
| 1 not added | 0 | 60 | >20,000 | X | 15.4 | 16.0 | 16.1 | X |
| 2 Na dodecylbenzene sulfonate | 2.0 | 60 | 16,000 | X | 13.8 | 16.2 | 16.8 | X |
| 3 Na dodecylbenzene sulfonate | 1.0 | 60 | >20,000 | X | 15.3 | 15.9 | 16.2 | X |
| 4 Na oleate | 2.0 | 60 | >20,000 | X | 15.0 | 15.8 | 16.6 | X |
| 5 Na oleyl sulfate | 2.0 | 60 | >20,000 | X | 15.3 | 15.8 | 16.3 | X |
| 6 Na oleyl sulfate | 1.0 | 60 | >20,000 | X | 15.6 | 15.7 | 16.4 | X |
| 7 POE (10 moles) | | | | | | | | |

TABLE 1-continued

| | Dispersing Agent | Results of Examples | | | | | | | |
|---|---|---|---|---|---|---|---|---|---|
| | | | | Flowability | | Ash Removing Property[5] (ash content) | | | |
| | | Amount[1] | Coal Concentration (%) | Viscosity[2] (cp) | Evaluation[3] | upper layer | intermediate layer | lower layer | Evaluation[3] |
| | nonylphenyl ether | 2.0 | 60 | >20,000 | X | 15.2 | 16.1 | 16.6 | X |
| 8 | POE (10 moles) nonylphenyl ether | 1.0 | 60 | >20,000 | X | 15.6 | 16.0 | 16.1 | X |
| 9 | Na dodecylbenzene sulfonate | 2.0 | 40 | 6,800 | Δ | 15.3 | 16.0 | 16.4 | X |
| Samples of Present Invention | | | | | | | | | |
| 1 | R = nonylphenyl, | 1.0 | 60 | 1,400 | O | 5.3 | 8.4 | 20.7 | O |
| 2 | m = 5, n = 1, M = Na | 0.5 | 60 | 2,100 | O | 6.6 | 10.1 | 19.7 | O |
| 3 | R = nonylphenyl, | 1.0 | 60 | 1,200 | O | 5.1 | 8.0 | 21.0 | O |
| 4 | m = 15, n = 1, M = Na | 0.5 | 60 | 1,900 | O | 7.2 | 10.7 | 19.3 | O |
| 5 | R = dibutylphenyl, | 1.0 | 60 | 1,300 | O | 4.9 | 8.3 | 20.2 | O |
| 6 | m = 5, n = 1, M = Na | 0.5 | 60 | 1,600 | O | 6.3 | 8.9 | 20.2 | O |
| 7 | R = n-hexyl, | 1.0 | 60 | 1,300 | O | 5.1 | 7.8 | 21.2 | O |
| 8 | m = 3, n = 1, M = Na | 0.5 | 60 | 2,200 | O | 7.2 | 10.3 | 19.0 | O |
| 9 | R = n-hexyl, | 1.0 | 60 | 1,800 | O | 4.8 | 8.1 | 21.0 | O |
| 10 | m = 3, n = 2, M = Ca | 0.5 | 60 | 2,100 | O | 7.1 | 11.1 | 18.8 | O |
| 11 | R = lauryl, m = 3, | 1.0 | 60 | 1,500 | O | 4.9 | 7.9 | 20.6 | O |
| 12 | n = 1, M = Na | 0.5 | 60 | 2,400 | O | 6.7 | 9.8 | 19.8 | O |
| 13 | R = lauryl, m = 10, | 1.0 | 60 | 1,400 | O | 5.4 | 8.8 | 20.4 | O |
| 14 | n = 1, M = Na | 0.5 | 60 | 2,300 | O | 7.3 | 10.6 | 18.9 | O |
| 15 | R = nonylphenyl, | 1.0 | 40 | 600 | O | 4.9 | 7.9 | 21.5 | O |
| 16 | m = 5, n = 1, M = Na | 0.5 | 40 | 900 | O | 6.8 | 9.9 | 19.2 | O |

Footnotes:
[1]% by weight based on the total slurry
[2]viscosity as measured at 25° C.
[3]O: good, Δ: slightly good, X: bad
[5]Some of the ash was removed by dispersing of the ash floating in the water The inventin being thus described, it will be obvious that the same may be varied in many ways. Such variations are not to be regarded as a departure from the spirit and scope of the invention, and all such modifications are intended to be included within the scope of the following claims.

We claim:

1. An aqueous slurry of coal powder having good flowability properties, which comprises coal powder, water and, as a dispersing agent therefor, an anionic surface active agent having the formula:

$$[R-O-(CH_2CH_2O)_m-SO_3]_nM$$

wherein R is an alkyl or alkenyl group having 6 to 22 carbon atoms or an alkyl- or alkenyl-substituted aryl group having 4 to 22 carbon atoms in the substituent thereof, m is an integer of from 2 to 50, n is a number of from 1 to 3 and is the same as the valence of the counter ion M, and M is a cation having a valence of from 1 to 3.

2. An aqueous slurry of coal powder in accordance with claim 1, wherein R is an alkyl-substituted phenyl group in which the alkyl substituent has from 6 to 18 carbon atoms.

3. An aqueous slurry of coal powder in accordance with claim 1, wherein R is an alkyl-substituted phenyl group in which the alkyl substituent has from 6 to 12 carbon atoms.

4. An aqueous slurry of coal powder in accordance with claim 1, wherein the amount of anionic surface active agent is about 0.01 to 5.0% by weight based on the total amount of the aqueous slurry.

5. An aqueous slurry of coal powder in accordance with claim 1, wherein the amount of anionic surface active agent is about 0.05 to 2.0% by weight based on the total amount of the aqueous slurry.

6. An aqueous slurry of coal powder in accordance with claim 1, wherein the amount of coal is about 30 to 85% by weight based on the total amount of the aqueous slurry.

7. An aqueous slurry of coal powder in accordance with claim 1, wherein the amount of coal is about 50 to 75% by weight based on the total amount of the aqueous slurry.

8. An aqueous slurry of coal powder in accordance with claim 1, wherein m is an integer of from 4 to 20.

9. An aqueous slurry of coal powder in accordance with claim 1, further including up to 50 mole %, based on the anionic surface active agent, of a non-ionic surface active agent.

10. A process for preparing an aqueous slurry of coal powder having good flowability so as to enhance transportation and handling which comprises incorporating into said slurry an anionic surface active dispersing agent having the formula:

$$[R-O-(CH_2CH_2O)_m-SO_3]_nM$$

wherein R is an alkyl or alkenyl group having 6 to 22 carbon atoms or an alkyl- or alkenyl-substituted aryl group having 4 to 22 carbon atoms in the substituent thereof, m is an integer of from 2 to 50, n is a number of from 1 to 3 and is the same as the valence of the counter ion M, and M is a cation having valence of from 1 to 3, and mixing said resulting aqueous slurry so as to thoroughly blend said dispersing agent therein.

11. The process of claim 10 wherein R is an alkyl-substituted phenyl group in which the alkyl substituent has from 6 to 18 carbon atoms.

12. The process of claim 10 wherein R is an alkyl-substituted phenyl group in which the alkyl substituent has from 6 to 12 carbon atoms.

13. The process of claim 10 wherein the amount of anionic surface active agent is about 0.1 to 5.0% by weight based on the total amount of the aqueous slurry.

14. The process of claim 10 wherein the amount of anionic surface active agent is about 0.05 to 2.0% by weight based on the total amount of the aqueous slurry.

15. The process of claim 10 wherein the amount of coal is about 30 to 85% by weight based on the total amount of the aqueous slurry.

16. The process of claim 10 wherein the amount of coal is about 50 to 75% by weight based on the total amount of the aqueous slurry.

17. The process of claim 10 wherein m is an integer of from 4 to 20.

18. The process of claim 10 further including up to 50 mole %, based on the anionic surface active agent, of a non-ionic surface active agent.

* * * * *